United States Patent [19]

Bednar et al.

[11] 4,367,794

[45] Jan. 11, 1983

[54] ACOUSTICALLY ACTUATED DOWNHOLE BLOWOUT PREVENTER

[75] Inventors: John M. Bednar, Houston; Clifford W. Petersen, Missouri City, both of Tex.

[73] Assignee: Exxon Production Research Co., Houston, Tex.

[21] Appl. No.: 219,631

[22] Filed: Dec. 24, 1980

[51] Int. Cl.[3] ..... E21B 33/127; E21B 34/06; E21B 34/16

[52] U.S. Cl. ..... 166/65 R; 166/187; 166/188; 166/330; 166/332; 166/373; 175/242

[58] Field of Search ..... 166/65 R, 72, 319, 321, 166/330, 332, 187, 188, 374, 375, 95, 53, 364, 212; 175/232, 241, 242

[56] References Cited

U.S. PATENT DOCUMENTS

| | | | |
|---|---|---|---|
| 2,874,927 | 2/1959 | Conrad | 166/334 X |
| 3,134,441 | 5/1964 | Barry et al. | 166/187 X |
| 3,283,823 | 11/1966 | Warrington | 166/187 X |
| 3,375,874 | 4/1968 | Cherry et al. | 166/114 |
| 3,427,651 | 2/1969 | Bielstein et al. | 166/187 X |
| 3,606,924 | 9/1971 | Malone | 166/187 |
| 3,661,205 | 5/1972 | Belorgey | 166/104 X |
| 3,941,190 | 3/1976 | Conover | 166/187 |
| 3,961,308 | 6/1976 | Parker | 175/48 X |
| 4,073,341 | 2/1978 | Parker | 166/65 R |

*Primary Examiner*—Stephen J. Novosad
*Attorney, Agent, or Firm*—E. T. Wheelock

[57] ABSTRACT

An acoustically operated downhole blowout preventer using a specially configured sleeve valve to inflate a resilient packer for shutting the wellbore annulus.

72 Claims, 10 Drawing Figures

ACOUSTICALLY ACTUATED DOWNHOLE BLOWOUT PREVENTER

BACKGROUND OF THE INVENTION

This invention relates to an improved self-contained downhole blowout preventer which is placed in a drill string and operates, upon control from the surface, to isolate a geologic formation by sealing off the annular space between a drill string and a borehole wall. It particularly relates to an acoustically operated electromechanical downhole blowout preventer which may be in the shape of a drill collar.

The equipment used in the rotary drilling of oil and gas wells consists of a long drill string which may extend many thousands of feet into the earth, a rotary table to turn the drill string, a derrick and its associated hoisting equipment, and the drill bit. The drill string itself is merely a series of detachable hollow pipe sections terminated at its lower end by the drill bit. This lengthy drill string requires two seemingly opposite forces acting upon it for proper operation. The drill string is kept in tension to prevent buckling or kinking by suspending it from rig hoisting equipment in the derrick. Conversely, the drill bit must have substantial downward pressure placed on it or the desired drilling does not take place. For this reason drill collars make up the lower end of the drill string just above the drill bit. Drill collars are thick-walled, heavy sections of pipe which replace some pre-determined length of drill pipe and result in a stable drill string with a properly weighted drill bit.

In using the described equipment to produce a borehole, it should be apparent that significant amounts of heat and drilling cuttings are produced. Both are removed by a drilling fluid often called "mud". The mud enters the hollow drill string at the surface, proceeds down through the drill pipe and drill collar sections, and finally exits the drill string through specially provided nozzles in the drill bit. As the mud leaves the drill string, it cools the drill bit and picks up whatever cuttings may be present. Some drill bit designs also rely upon the potentially significant hydraulic force of the mud exiting the bit nozzles to add to the overall drilling effect. In either case, the mud proceeds up the annular space found between the drill string and the borehole wall to the surface. The mud is then screened, reconstituted, and recycled to the drill string.

Drilling mud can serve a number of other important functions as it cycles through the well. For instance, it may be used to control relatively low or relatively high subsurface pressures. Drilling a well to any significant depth often requires the bit to penetrate rock and sand strata of widely varying composition. Certain depleted Gulf Coast gas sands have localized or formation pressures that are so low and porosities that are so high that a sizeable portion of the drilling mud disappears into these strata rather than returning to the surface. The addition of certain clays, such as bentonite, to the drilling mud will often remedy the situation. Bentonite is a clay which, when included in the drilling mud using proper techniques, forms a dispersed mixture of flat platey particles. These particles form a thin and relatively impermeable filter cake on the borehole wall in the region of the offending "thief" stratum. The filter cake substantially prevents further loss of mud into the stratum and allows circulation of the mud to resume.

At the other end of the pressure control spectrum lies the problem of containing a high pressure fluid within the well. For instance, when a subsurface formation containing a high pressure fluid is penetrated, the localized pressure of the fluid may well exceed the liquid or hydraulic head of the mud lying above it. When this occurs, a "kick" is observed and may eventually result in a "blowout" of the drilling mud from the wellbore annulus. A mud having a higher specific gravity, and resulting in a correspondingly higher hydraulic head at the downhole drilling site, is introduced into the well. The higher density mud is intended to keep the formation fluid in its stratum.

Since the well is sealed off at the surface, the possibility exists that a significant volume of high pressure formation fluid will enter and fill the entire wellbore. If such occurs, downhole pressure may increase to the point that the integrity and safety of the well is threatened. If the formation fluid influx can be isolated lower downhole, then the pressure build-up could be minimized, the formation fluid influx minimized, and the integrity of the well maintained. A downhole BOP suitable for isolating a high pressure stratum, however, is difficult to design in that it must fit inside a relatively narrow borehole, be compatible with the drill string and its auxiliary equipment, and remain reliably operative during infrequent emergencies.

A downhole BOP can be mounted just below a circulation sub which allows fluid communication between the pipe bore and the annulus. The BOP would, therefore, seal off the annulus with an exterior bladder or packer at a point in the borehole above the flowing formation. A heavy weight or "kill" fluid could then be circulated down the drill and back up the annulus above the BOP utilizing the circulation sub. Once the heavy weight drilling fluid is in position and able, by its hydraulic head, to maintain the formation fluid in its stratum, the downhole BOP could be deflated and drilling re-commenced.

The disclosed downhole BOP is especially suitable for physically isolating a stratum containing high pressure fluid during the interim between observation of a kick and circulation of the high density mud to the wellbore annulus.

The operation of a known downhole packer is found in U.S. Pat. No. 2,779,419, to Mounce.

A circulation sub particularly suitable for use with the BOP disclosed herein is found in Ser. No. 218,602, filed Dec. 19, 1980, to Bednar et al, the entirety of which is incorporated by reference.

The few known circulation subs and downhole BOPs typically have been mechanically actuated. That is to say that the driller sets these devices in motion other than through acoustic, electrical, or hydraulic means. A representative of such a mechanically actuated combination is found in U.S. Pat. No. 3,941,190, to Conover. The circulation sub, disclosed in conjunction with a downhole packer suitable for use as a blowout preventer, utilizes a sleeve valve to cover the required drilling fluid circulation ports. The sleeve valve is kept in a position covering the ports during normal drilling operations by a spring. Actuation of the circulation sub requires the insertion of a metal plug known as a "go-devil" into the pipe bore from the surface. The go-devil falls to a seat in the vicinity of the sleeve valve and utilizes the localized pressure in the pipe bore to slide the seated go-devil and sleeve valve down and away from the mouth of the circulation ports. In order to re-start drilling operations, the driller must fish the go-devil out of the drill string along with some associated packer machinery which plugs the pipe bore.

Other representative inflatable packers, which are actuated by devices inserted into the drillpipe and dropped to the vicinity of the packers, are found in U.S. Pat. No. 3,529,665 and U.S. Pat. No. 3,606,924, both to Malone, and U.S. Pat. No. 3,850,240, to Conover.

As noted above, the inventive BOP is desirably acoustically actuated. Acoustically operated downhole devices are known. For instance, U.S. Pat. Nos. 3,961,308, 4,073,341, and 4,129,184, all to Parker, discuss the use of acoustic waves to actuate the disaster valves often found in the tubing of product wells to shut off the flow of hydrocarbon fluids. However, the application of acoustic actuation to drill pipe and drill collars in a non-cased well is not a trivial matter. The disclosed invention in its acoustically operated configuration is capable of operation in wells which are cased or non-cased.

The theoretical use of torsionally propagated acoustic waves in the drill string to provide downhole communication is suggested in a paper entitled "A New Approach to Drill-String Acoustic Telemetry" by Squire and Whitehouse. This paper, SPE 8340, was presented at the Fall 1979 conference of the Society of Petroleum Engineers of AIME.

It is apparent in this prior art that there is no disclosure or suggestion concerning the unique valving configuration utilized in controlling the inventive BOP. Similarly the use of electric motors, acoustically actuated or not, to control such a valving configuration is not shown.

SUMMARY OF THE INVENTION

This invention relates to a downhole BOP having special application as an integral portion of a drillstring. It is desirably self-contained, battery-powered and actuated by a coded acoustic signal transmitted from the surface. It does not require the insertion of a go-devil or steel ball for actuation. It has a control valve arrangement which permits use of pressure as the motive force in sealing the annulus.

When actuation of the tool is desired, an acoustic signal is transmitted from the surface, preferably through the drillpipe, to the acoustic receiver. The receiver activates the electric motors connected to the control valve. The control valve, a movable sleeve situated on the inside diameter of the BOP housing and optimally having short longitudinal recesses on its outside, slides down thereby opening a passageway between the BOP's interior and the packer located on the outside of the BOP. Since the pressure of the drilling fluid in the BOP's interior can always be raised to a pressure significantly higher than the pressure outside, the rubber-chambered packer can be expanded to fill the annulus.

Similarly, when the BOP is to be deflated, an acoustic signal is transmitted down from the surface. The receiver, in response to the signal, actuates the motors to restore the sleeve control valve to its original position. The control valve, via its exterior recesses, opens a passageway between the packer and the BOP exterior. The packer then deflates.

It is also contemplated that the control valve assembly have a flapper valve which prevents downward flow of drilling fluid during the period the packer is inflated. The flapper valve is placed within the tool in such a manner that it is hidden in a cavity behind the control valve sleeve when not in use. The flapper valve itself has a unique shape allowing it to retract into the provided cavity upon contact with the control valve sleeve during the BOP's deflation sequence. The flapper valve's shape provides some cam action during its rotation back into the cavity and helps to minimize stress on the valve's pivot pin.

It is also contemplated that the inventive BOP optimally have a safety deflation sleeve to disable the BOP should the actuating mechanism fail at an inopportune time. If, for instance, the batteries prematurely discharge and thereby prevent the control valve from responding to acoustic signals from the surface and deflating the packer, the safety deflation sleeve provides a method of doing so. The sleeve is designed so that after actuation by either go-devil or wireline, the drilling fluid in the packer drains allowing the packer to deflate and the drilling fluid in the drill string bypasses the flapper valve.

DESCRIPTION OF THE PREFERRED EMBODIMENT

Figure 1:
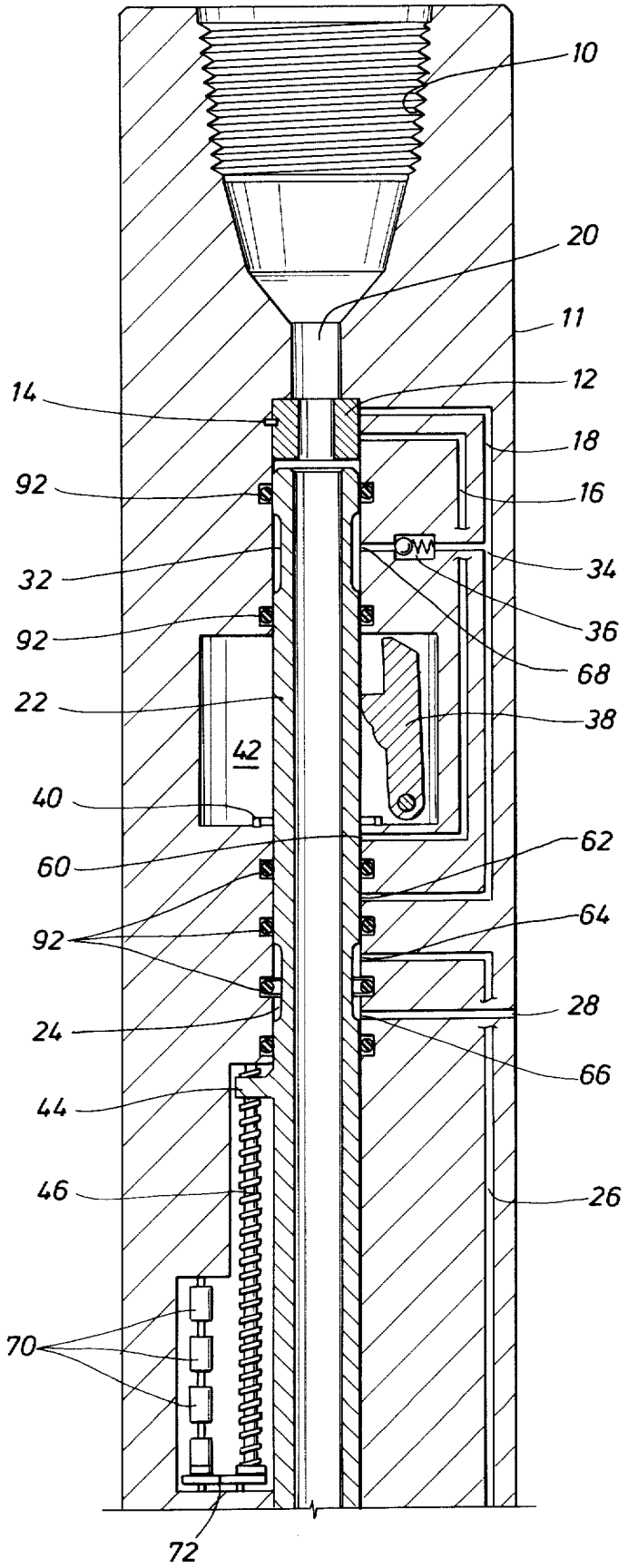
FIGS. 1-3 when laid end-to-end schematically depict in longitudinal cross-section, the preferred embodiment of the invention.

As mentioned above, the inventive BOP is a conceptually simple device, preferably having the shape of a section of drill collar, which utilizes the difference in pressure between the drillstring bore and the wellbore annulus to inflate an open hole packer.

The downhole BOP is divided into two major portions: the control valve section and the packer section.

The control valve section is made up of several parts. The first is a control valve fashioned in the shape of a sleeve. The outer surface of the control valve sleeve fits on the inside bore of the tool housing and slides up and down upon urging by an acoustically actuated motor. The control valve sleeve has recesses in its outer surface which allow the packer to see either the pressure in the annulus or the relatively higher pressure in the pipe bore. During normal drilling, the sleeve valve allows fluid communication between the packer and the annulus. Since the outside of the packer is in the annulus, the packer is pressure balanced and remains deflated. If high pressure drilling mud from the pipe bore leaks into the control valve section of the BOP, the fact that the packer is open to the annulus allows that fluid to flow into the annulus rather than inflating the packer and causing a problem. When well control problems occur and the sleeve valve is moved to its other position, the recesses in the sleeve align with a series of passageways in the tool housing to allow high pressure pipebore fluid to enter the packer. Since the pressure on the inside of the resilient packer is higher than that on the outside, it inflates.

The control valve section also includes a flapper valve hidden, during drilling operations, in a chamber behind the control valve sleeve. When the BOP is activated, the flapper valve closes the pipe bore and directs drilling fluid normally flowing downward to the bit into the packer inflation passageways.

Also included is a control valve motor drive assembly actuated by an acoustic receiver taking commands from a transmitter on the surface. The motor drive assembly in the preferred configuration drives the sleeve valve down and causes two significant things to happen. First, an enclosure which houses the flapper valve is opened and the flapper valve closes the pipe bore to any further downward flow of driling fluid. Secondly, a series of passageways in the tool housing and a recess in the control valve sleeve align to expose the packer to the pressure of the pipe bore. The flapper valve diverts drilling fluid into those passageways and that fluid is used to inflate the packer and consequently seal the annular space between the borehole wall and the drill pipe.

The BOP is de-activated by sending another acoustic signal from the surface. The motor drive assembly moves the control valve sleeve back up to its original position. The upper end of the control valve sleeve pushes the flapper valve back into its housing. Simultaneously, a recess in the outer surface of the control valve sleeve connects separate passageways leading to the annulus and the packer chamber. The fluid in the chamber bleeds to the annulus and deflates the packer.

The remaining major portion of the BOP, the packer section, is normally, though not necessarily, located in the lower end of the tool and is made up of an open hole packer of conventional design.

FIG. 1 shows the uppermost end of the preferred BOP configuration. The BOP is preferably in the form of a section of drill collar having a female threaded portion or tool joint 10 suitable for mating with a similarly threaded tool joint on a drill collar or another tool. The BOP normally would be mounted just below a circulation sub in a drill string. The portion of the tool found in FIG. 1 contains all of the valving necessary to operate the BOP. The upper end of the tool also houses the safety deflation sleeve 12, its shear pin 14, flapper bypass passageway 16, and the check valve bypass passageway 18. These components are used only when the BOP cannot be deactivated in a normal fashion from the surface. They will be discussed in detail below.

Situated within the BOP central bore 20 just below the safety deflation sleeve 12 is the control valve sleeve 22. This sleeve is a hollow open cylinder which fits tightly within a bore provided in the BOP housing 11. The sleeve is adapted to slide up and down within the bore. The control valve sleeve 22 has several functions. During drilling operations, i.e., when the control valve sleeve 22 is in the "up" position illustrated both in FIG. 1 and FIG. 6-A, the inside bore of the sleeve 22 directs drilling mud down to the drill bit. Meanwhile, a circumferential recess, the deflation recess 24, in the outside diameter of the sleeve 22 allows the packer 30 (FIG. 3) to remain deflated by providing fluid communication from the packer passageway 26 with the exterior drain 28.

Figure 6A:
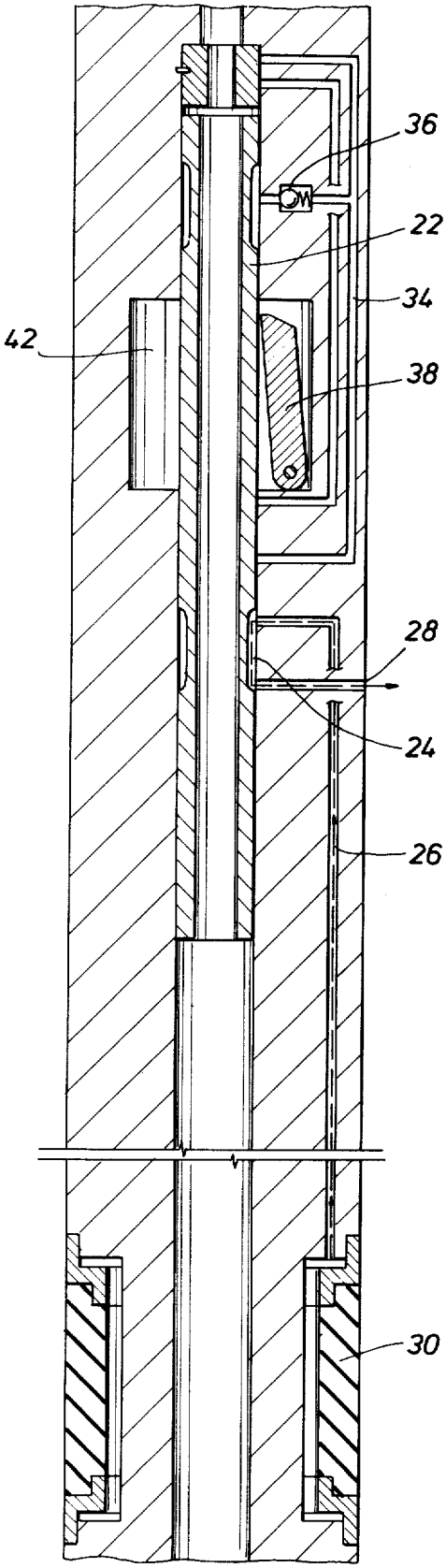
FIGS. 6A and 6B show the preferred BOP during normal drilling operations and after actuation.
Figure 6B:
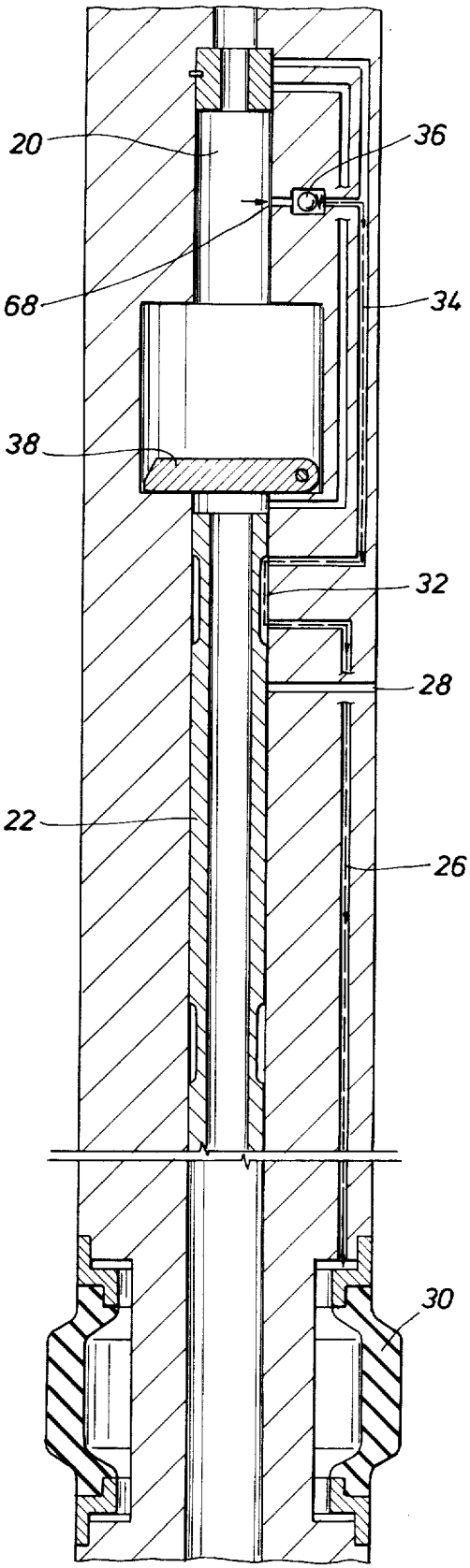

Conversely, when the control valve sleeve 22 is in the "down" position activating the BOP, as illustrated in FIG. 6B, inflation passageway 34 is exposed to the pipe bore 20. High pressure drilling fluid in the pipe bore may then pass into inflation passageway 34, through check valve 36, through inflation recess 32 in the outside diameter of control valve sleeve 22, into packer passageway 26 and thence to packer 30.

Recesses 24 and 32 are desirably circumferential recesses in the outside of the control valve sleeve 22. However, the invention is not so limited. For instance, recesses 24 and 32 may be short axial splines in the outside of the sleeve 22 operating alone or in conjunction with circumferential recesses in the inside bore of the sub housing 11.

The control valve sleeve 22 is adapted to allow secure attachment to the motor drive assembly. In the configuration shown in FIG. 1 which has a ball nut 44 and ball screw 46, the ball nut 44 slips snugly into a recess in a collar (not shown) clamped about valve sleeve 22. However, any method of attaching the ball nut to sleeve 22 is acceptable.

Figure 4A:
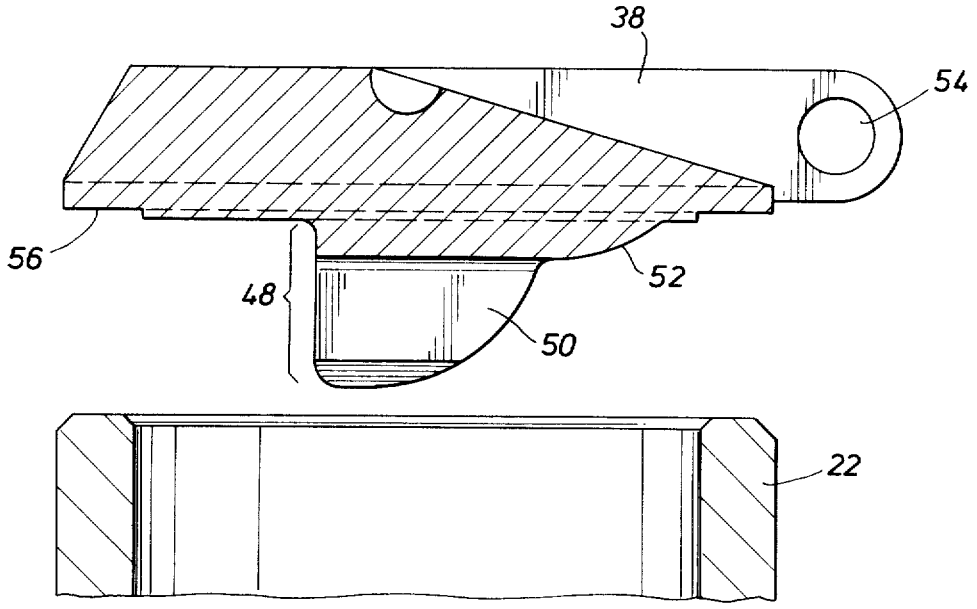
FIGS. 4A and 4B have the flapper valve in side view and in front view.
Figure 4B:
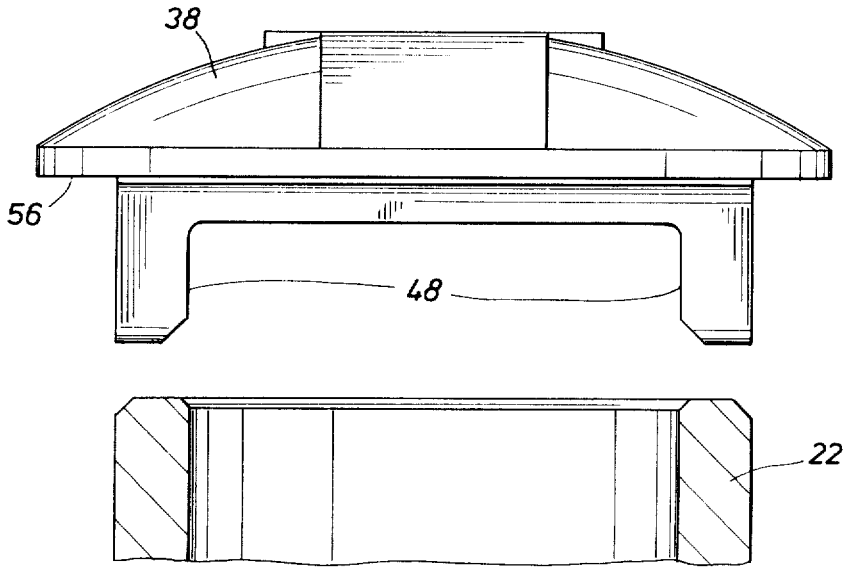

Flapper valve 38 is intended to close the BOP central bore 20 by contacting with seal 40 when the control valve sleeve 22 is pulled down to allow inflation of packer 30. Prior to use, the flapper valve 38 resides in a cavity 42 which is isolated from the BOP central bore by control valve sleeve 22. The flapper valve 38 remains clean and remote from any drilling fluid prior to its first use. Opening the flapper valve 38 and returning it to its cavity 42 is accomplished by moving the control valve sleeve 22 upward. The top end of control valve sleeve 22 is preferably flat although the sleeve valve wall may be rounded to assist in rotating the flapper back into its cavity 42 without burring the valve sleeve. Flapper valve 38 desirably has the shape shown in FIGS. 4A and 4B. Each of the lifting legs 48 desirably has two cam-type surfaces. Primary cam 50 is located on the flapper valve 38 so that its initial point of contact with control valve sleeve 22, during the sleeve's upward course in the deflation sequence, is at about the midpoint of the flapper valve. In this way the stress on the pivot pin in pivot hole 54 is minimized. Once the flapper valve 38 has begun to open, the static pressure on it begins to decrease. When rotation of the flapper valve 38 in FIGS. 4A and 4B reaches about 55°-65° from closed, the secondary cam 52 then contacts the top of the sleeve valve 22 finally urging the flapper valve back into its cavity 42.

The flapper valve 38 may also have small recesses 56 to provide a more effective seal on seal 40. It is also desirable to provide a torsional closure spring about the pin in pivot hole 54 to help close the flapper valve when the sleeve valve 22 is drawn downward to inflate packer 30.

Situated just below the flapper valve cavity 42 is the lower opening 60 to the flapper bypass passageway 16. This opening is positioned so that it is above the upper end of control valve sleeve 22 when that sleeve is in its lowermost position and open to BOP central bore 20. As mentioned above, passageway 16 is one of the emergency features of the BOP and allows drilling fluid to bypass the flapper valve 38 in the event that the acoustic actuators are inoperative while the control valve sleeve 22 is down, flapper valve 38 has closed the pipe bore, and the open hole packer 30 is inflated.

Situated below the lower opening 60 to the flapper bypass passageway is a series of three control passageway openings. In descending order are found: opening 62 to the packer inflation passageway 34, opening 64 to the packer passageway 26, and opening 66 to drain 28. The three openings are spaced so that when the control valve sleeve 22 is in its uppermost position (the position illustrated in FIGS. 1 and 6A), the openings 64 and 66 are both open to the deflation recess 24 in control valve sleeve 22. This, of course, allows any drilling fluid present in the packer 30 to flow through packer passageway 26, opening 64, recess 24, opening 66 and exit through packer drain 28 into the wellbore annulus.

During inflation of the packer, the control valve sleeve 22 will be at its lowermost position (the position illustrated in FIG. 6B) and inflation recess 32 will bridge the gap between openings 62 and 64. The sleeve will also cover the opening 66 to packer drain 28. During packer inflation, drilling fluid will enter via opening 68, proceed through inflation passageway 34, check valve 36, opening 62, control valve recess 32, and opening 64 before entering packer 30 through packer line 26. The relative position of sleeve valve 22, the movement of drilling fluids through the BOP, and the resulting effect on packer 30 are illustrated in FIG. 6B.

Figure 2:
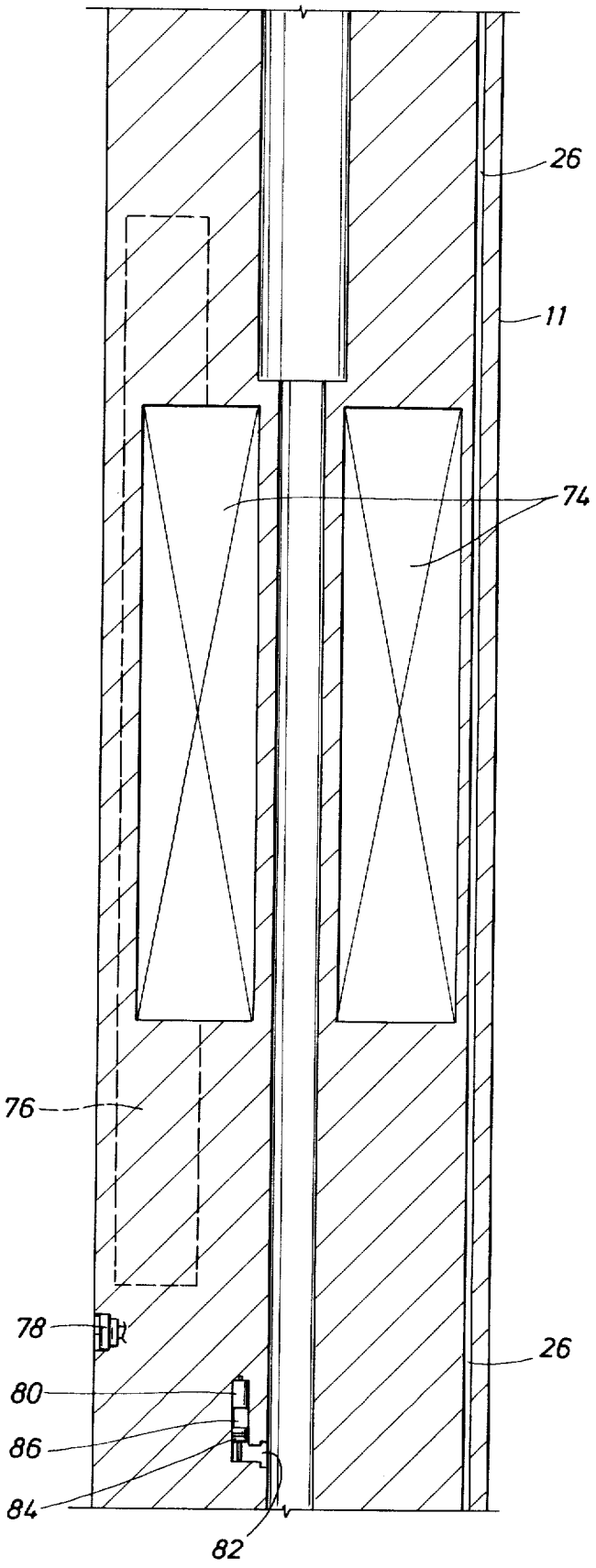
Figure 3:
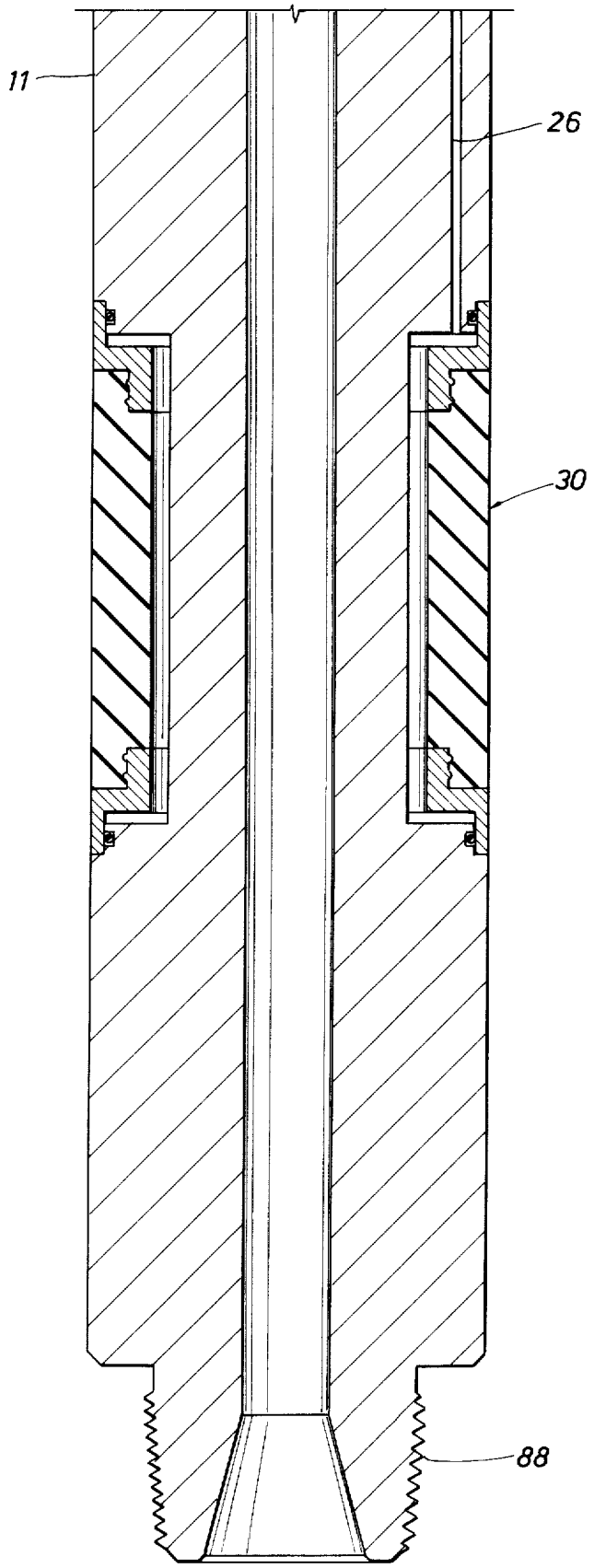

It must be emphasized that although the various passageways are schematically depicted in FIGS. 1–3 as entailing a single passageway, the invention is not so limited. It is desirable that redundant passageways be used, or that the passageways be formed by gaps between subcomponent subs and mandrels building up the BOP body 11, or a combination of the two. The passageways, no matter how constructed, should be as large and as numerous as is possible to minimize the chances of plugging those passageways with solids from the drilling fluid. Of course, the BOP must be able to withstand the stresses placed on it during drilling operations. The schematic representation of a single check valve 36 in FIG. 1 similarly should not be taken as limiting the invention. It is preferable to provide multiple check valves to minimize the chances of the check valves plugging and thereby impeding the ability to inflate the packer 30.

The motor drive assembly physically moves the control valve sleeve 22. The motive force is supplied by a number of ganged electric motors 70 driving a ball nut 44 and ball screw 46 assembly through a gear box 72. The assembly may be mounted in the vicinity of passageway openings 62, 64, and 66. However, as shown in FIG. 1, the motor drive assembly is desirably placed substantially below the region of the flapper valve 38. It should be apparent that the large number of passageways in sub housing 11 in the region of the flapper valve cavity 42 may, in some circumstances, require that bulky components such as the motor drive assembly be placed elsewhere in the BOP. It is preferable to use two independent motor drive assemblies mounted on opposite sides of the control valve sleeve. Each assembly may be made up of two gangs of three series-connected motors driving a single gearbox. The gearbox 72 drives the ball screw 46 in the manner illustrated in FIGS. 1 and 5.

Figure 5:
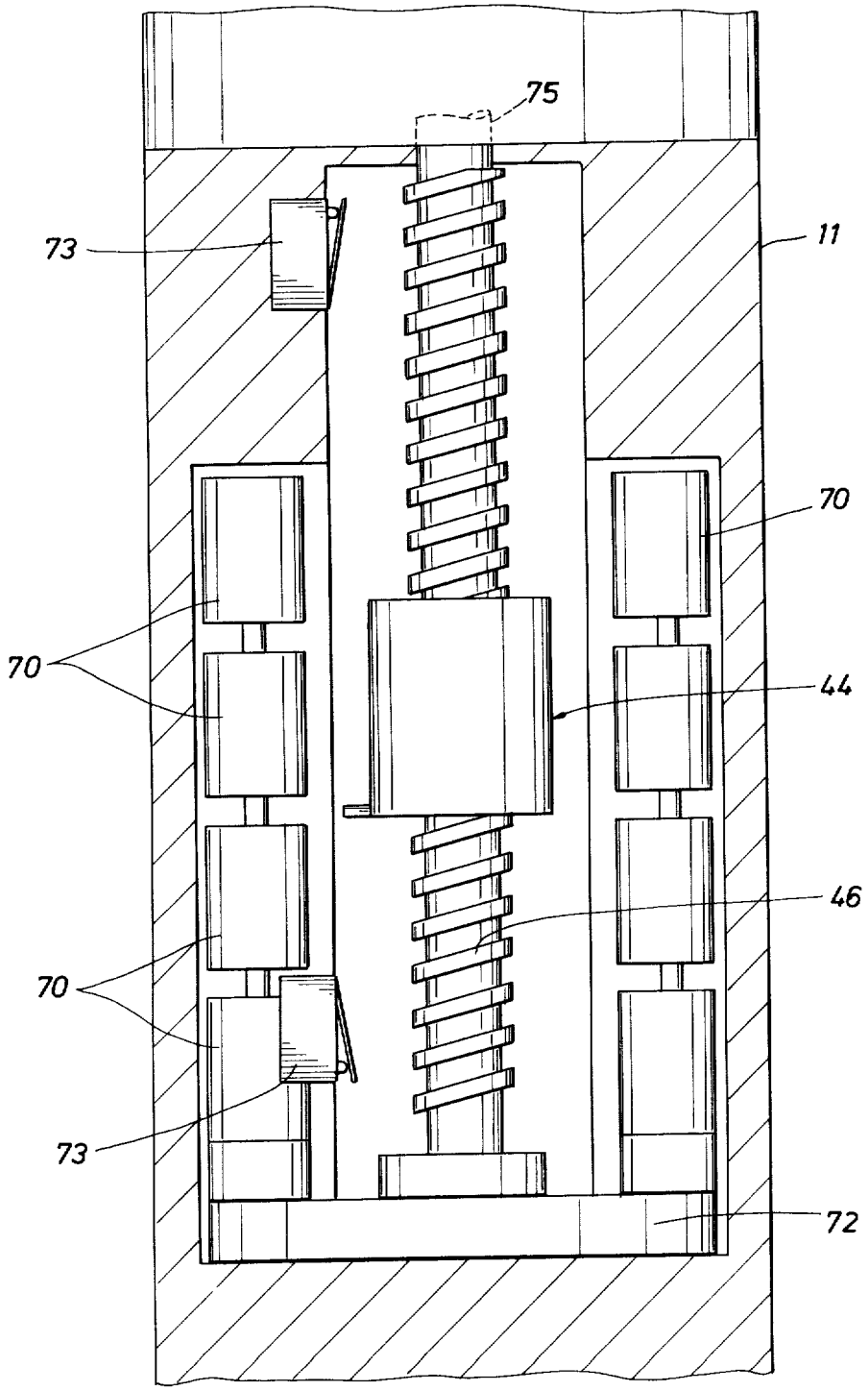
FIG. 5 shows an elevation of the control valve motor drive assembly.

As shown in FIG. 5, limit switches 73 may be placed at each end of the ball nut 44 travel. The limit switches 73 provide assurance that the control valve sleeve 22 moves only so far, in either direction, as is necessary to provide fluid communication between the middle opening 64 to the packer and either of the two remaining openings 62 or 66. The motor drive assembly need not be as elaborate as the one illustrated in FIG. 5. The drive may comprise other layouts such as a single motor direct drive or a solenoid to move the control valve sleeve 22. Well-known hydraulic actuators are suitable. Each different layout has its benefits and detriments, although, from a reliability viewpoint the illustrated motor drive assembly is highly regarded.

It is additionally desirable to include as an extension of the ballscrew 46 shaft a brake shaft 75. A brake (not shown) will clamp on the shaft 75 during normal drilling. The brake prevents the control valve sleeve 22 from accidentally vibrating down into a position actuating the packer 30.

FIG. 2 schematically depicts the middle portion of the inventive BOP. Within that section is found the acoustic receiver 74 and its associated electronics. The receiver intercepts an acoustic signal relayed from the surface and actuates the motors 70 which move the control valve sleeve 22.

The acoustic receiver 74 and its associated electronics can be of a design such as that found in U.S. Pat. No. 3,961,308, mentioned above. Encoding the surface-originated command to open or close the sleeve valve 22 as a series of binary digits is an excellent method of relaying that command to the circulation sub assembly. Desirably the binary zero is a torsionally or longitudinally modulated frequency shift keyed (FSK) signal of about $310\pm20$ Hz or most preferably $316\pm4$ Hz. The binary one is preferably $370\pm20$ Hz and most preferably $374\pm3$ Hz. Of course, the frequencies enumerated for the binary one and the binary zero may be swapped one for the other with no difference in utility. Higher frequencies tend to quickly attenuate as they traverse the drill pipe; lower frequencies are often in interference with naturally-occuring noises in the borehole. See U.S. patent application Ser. No. 113,831 filed Jan. 31, 1980, now U.S. Pat. No. 4,314,365.

The method of modulating the acoustic signals forms no part of this invention. The signals may be modulated in any desirable manner and using any transmission means available; i.e., longitudinal or torsional modulation using the drill pipe as the transmission medium; longitudinal or radial modulation using the drilling fluid as the transmission medium, or any combination thereof.

The battery packs 76 may be of any type acceptable to do the job in the wellbore environment. Nickel-cadmium, or "NICAD", batteries are suitable and are commercially available in many forms and sizes. It should be noted that most battery systems have a decline in voltage output with an increase in temperature. In drilling a well that is especially deep and therefore hot, choice of a battery type can be critical. The rated voltage of the battery pack must be sufficient at the downhole temperature to meet the operational voltage of the drive motors. Inclusion of the battery pack in a protective sleeve may be desirable.

The configuration shown in FIG. 2 includes an external outlet 78 with connective leads to allow recharging of the battery pack while the BOP is on the surface. This negates the need for disassembly of the device for battery charging.

Another illustrated feature which adds to the reliability of the BOP is the pressure switch assembly. This assembly uses an electrical switch 80 which senses the localized pipe bore pressure through a port 82. If the pressure is below or near, e.g. within 100 psi of, atmospheric pressure, the pressure switch assembly cuts off all electrical power from the batteries 76 to the acoustic receiver 74 and drive motors 70. The major function is preservation of battery life by turning off the BOP when it is at or near the surface.

The pressure switch 80 is isolated from direct contact with the drilling fluids found in port 82 by an isolation piston 84. This piston has drilling fluid on the port side and an inert fluid, such as an oil, on its switch side in an isolation chamber 86. As the BOP is lowered in a borehole, and the hydrostatic head of the drilling fluid increases to the point that piston 84 begins to move, the fluid in the isolation chamber 86 further actuates the pressure switch 80. A spring return on the pressure switch 80 provides an opposite motion when the pressure is lowered as the BOP is run out of the hole.

FIG. 3 depicts the bottom portion of the BOP. The open-hole type inflatable packer 30 is found therein. Such packers are normally made of an elastomeric compound and therefore are inflatable. Packer 30 is inflatable via the drilling fluid introduced through packer line 26. Open hole packers are capable of sealing the annulus in an effective manner. Experience has shown that such packers can maintain the annular seal even during small longitudinal movements of the drill string.

The BOP is subended by a tool joint 88 which allows it to be attached to a section of drill pipe or drill collar.

FIGS. 1-3, as noted above, are only schematic in nature. Certain components have been deleted for the sake of simplicity in explanation. For instance, good engineering practices suggest the installation of seals 92 in the wall of the BOP control bore 22 between each port leading to a fluid passageway. These seals have the function of preventing liquid seepage between adjacent passageways. Seepage of high pressure fluid into the packer during normal drilling could result in undesirable inflation. Conversely, seepage of high pressure fluid out of the packer when inflation is desired could result in a well blowout. Certain of the seals, for instance those that are placed between the openings of the flapper bypass passageway 16 and the inflation passageway 34, will be of a design that is self supporting. When control valve sleeve 22 is pulled to its lowermost position, the seal between passageways 16 and 34 will be without inner support. A resilient seal, e.g. "0" ring, might well be lost in the BOP central bore. An acceptable choice for a self-supporting seal is the commercially available "MOLY-GLAS" type.

FIGS. 1-3 also exclude the optional feature of strainer rings in the openings leading to each of the liquid passageways. It is not desirable that the drilling fluid found inside those passageways have large solids contained within. Strainer rings lessen the chances that large solids will enter the passageways and block liquid flow.

It should also be clear that the BOP body 11 portrayed in FIGS. 1-3 is not a monolithic piece of steel but is desirably a number of different mandrels and subassemblies.

The operation of the BOP is schematically illustrated in FIGS. 6A and 6B. FIG. 6A shows the BOP during normal drilling operations. The packer 30 is deflated since the control valve sleeve 22 is in its upper position. The packer 30 "sees" the pressure of the wellbore annulus via packer line 26, the deflation recess 24 in the control valve sleeve 22, and the drain port 28. During this period, the flapper valve 38 remains hidden in its cavity 42 behind the control valve sleeve 22. Similarly the inflation passageway 34 and its check valve 36 remain clean and unused behind the control valve sleeve 22.

Upon reception of a proper acoustic signal from the surface, the motor drive assembly (not shown in FIGS. 6A and 6B) pulls the control valve sleeve 22 down into the position illustrated in FIG. 6B. This movement allows the flapper valve 38 to fall into the central bore 20 of the BOP and seal it off. Simultaneously the inflation cavity of packer 30 is exposed to the higher pressure of the BOP central bore 20. In inflating the packer, drilling fluid from the bore passes through the opening 68, through check valve 36, inflation passageway 34, the inflation recess 32 in control valve sleeve 22, and finally through packer passageway 26. When the control valve sleeve 22 is in this position, it closes the packer drain 28. In actual operation, it is commonly necessary to raise the pressure of the drilling fluid in the central bore 20, using the rig pumps, to assure complete inflation of the packer 30. Once the packer 30 is inflated, the bore pressure can be lowered. The check valve 36 prevents the drilling fluid inflating the packer from back flowing into the central bore 20.

Upon rare occasions, the BOP may malfunction because of dead batteries or electronics breakdown and leave both the packer 30 inflated and the flapper valve 38 closed. Further operations of any kind become a virtual impossibility. Drilling cannot be continued since drilling fluid no longer cools the drill bit nor carries away formation cuttings. The drill string does not turn readily with the packer inflated. Running out of the hole is most difficult since the drillstring is filled with dense drilling fluids. Pulling the drillstring with the packer inflated creates a large relative vacuum behind the packer and may cause the borehole to be "swabbed in".

Figure 7A:
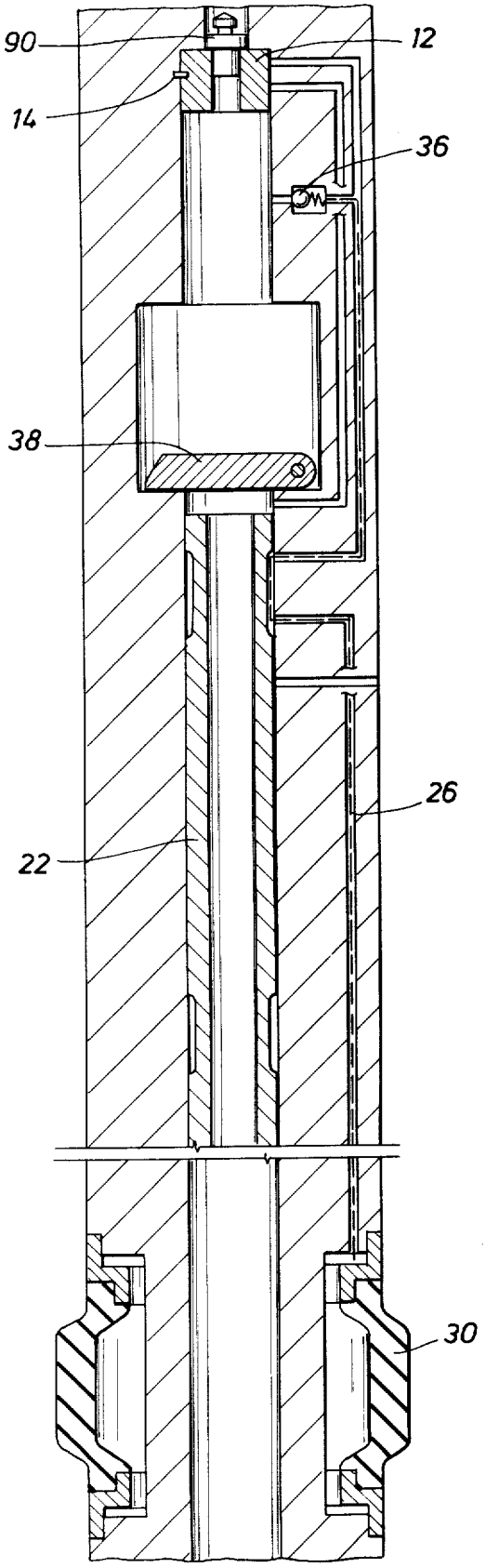
FIGS. 7A and 7B show operation of the safety sleeve.
Figure 7B:
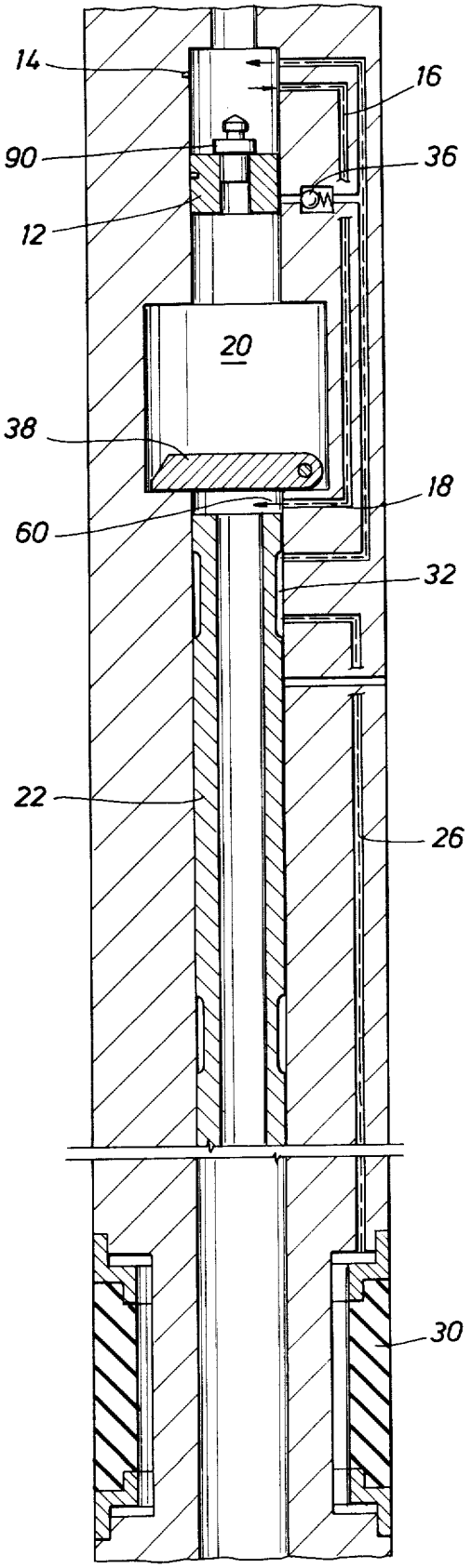

FIGS. 7A and 7B illustrate operation of the optionally included components allowing disablement of the BOP after a malfunction.

In FIG. 7A, the packer 30 is inflated and the flapper valve 38 is closed. Sleeve valve 22, for one reason or another, cannot be moved. A plug or "go-devil" 90 is inserted into the drill pipe bore and it comes to rest in the inner bore of safety deflation sleeve 12.

As shown in FIG. 7B, after the drill pipe pressure is raised, the safety deflation sleeve 12 cuts its shear pin 14, slides down the BOP central bore 20, and uncovers the openings to the flapper bypass passageway 16 and check valve bypass passageway 18.

In bypassing the check valve 36, the packer 30 is deflated by flow of drilling fluid through packer passageway 26, inflation recess 32 in control valve sleeve 22, and check valve bypass passageway 18. The fluid formerly inflating the packer is now in the pipe bore.

Once the packer is deflated, the drill string may be pulled from the borehole. Drilling fluids in the drill string drain from the pipe bore volume above flapper valve 38 through the flapper bypass passageway 16 and out opening 60. The fluids will further exit through nozzles in the drill bit into the empty borehole. The drill string thus need not be pulled while full of liquid. It is additionally desirable to include a loose-fitting ball-and-seat assembly, or "junk valve" (not shown), in the check valve bypass passageway 18. The ball-and-seat assembly acts as an imperfect check valve and allows drilling fluid to exit the packer 30 during a situation in which the safety sleeve 12 has been actuated. However, it prevents drilling fluid from re-entering and inflating the packer as the drill string is run out of the hole. The drilling fluid in the pipe bore 20 drains around flapper valve 38 through flapper bypass passageway 16.

Although FIG. 1 shows a safety sleeve configuration in which a go-devil pushes the sleeve down, the invention is not limited to that variation. The safety sleeve 12 may also have a latch suitable for attachment to a conventional wire line. In this way, with proper modification of sub housing 11 to allow upward movement of the sleeve, safety sleeve 12 may then be either pulled up by a wire line or pushed down by a go-devil to disable the BOP.

The relative position of the components of the inventive BOP can be varied within the scope of the invention. The drawings and description are only for the purpose of illustration. Changes in size, shape, materials of construction, configuration, as well as in the details of the illustrated construction may be made within the scope of the appended claims without departing from the spirit of the invention.

We claim:

1. A device suitable for use as a downhole BOP in a well comprising:

a housing having an inner bore, an exterior wall, an inflatable packer which extends beyond the exterior wall when inflated, at least one first passageway extending between the inner bore and the exterior wall, at least one second passageway extending between two openings on the inner bore, at least one inflation passageway extending between an opening on the inner bore and the packer, a control valve assembly having a sleeve-shaped valve body slidably mounted in the inner bore of the housing and adapted to provide, in a first position, open fluid communication between the inflation passageway and the exterior wall of the housing through said first passageway whereby the packer is deflated, and, in a second position, open fluid communication between the inflation passageway and the inner bore through said second passageway whereby the packer can be inflated, a flapper valve adapted to substantially close the inner bore of the housing when the sleeve-shaped valve body is in its second position.

2. The device of claim 1 wherein said at least one second passageway has at least one check valve interposed therein to substantially prevent deflation of the packer when the sleeve-shaped valve body is in the second position.

3. The device of claim 1 wherein the housing has a recess which is covered by the sleeve-shaped valve body when it is in its first position and houses the flapper valve.

4. The device of claim 3 wherein the flapper valve has lifting legs adapted to open the flapper valve and rotate it into said recess by contact with the sleeve-shaped valve body during its movement from said second position to said first position.

5. The device of claim 4 wherein the lifting legs have at least one cam ramp thereon adapted to contact the sleeve-shaped valve body.

6. The device of claim 1 wherein the sleeve-shaped valve body is adapted to provide said fluid communication in said first and second position by at least two circumferential recesses in the sleeve-shaped valve body adjacent the housing inner bore.

7. The device of claim 1 wherein the housing has circumferential recesses on its inner bore about the opening on the inner bore of the first passageway, about the two openings on the inner bore of the second passageway, and about the opening on the inner bore of the inflation passageway and the sleeve-shaped valve body has short longitudinal recesses adapted to cooperate with said circumferential recesses and provide said fluid communication in said first and second positions.

8. The device of claims 1, 2, 3, 4, 6 or 7 additionally comprising actuating means for slidably moving the sleeve-shaped valve body from said first to second position and back.

9. The device of claim 8 wherein the actuating means comprise at least one electric motor.

10. The device of claim 9 wherein the actuating means comprise at least one assembly of two series of three electric motors driving a ball screw through gears and a ballnut driven by the ballscrew and attached to the sleeve-shaped valve body.

11. The device of claim 10 wherein the ballscrew is adapted to comprise a brake when not slidably moving the sleeve-shaped valve body.

12. The device of claim 10 wherein limit switches are positioned about the ballnut so as to stop the sleeve-shaped valve body at either its first or second positions.

13. The device of claim 8 wherein the actuating means comprise at least one electric solenoid.

14. The device of claim 8 wherein the actuating means comprise hydraulic actuators.

15. The device of claim 1 wherein the housing is adapted at its upper and lower ends to connect to well drilling pipe or collars.

16. A device suitable for use as a downhole blowout preventer in a well comprising:

a housing having an inner bore, an exterior wall, an inflatable packer which extends beyond the exterior wall when inflated, at least one first passageway extending between the inner bore and the exterior wall, at least one passageway extending between two openings on the inner bore, at least one inflation passageway extending between an opening on the inner bore and the packer, a control valve assembly having a sleeve-shaped valve body slidably mounted in the inner bore of the housing and adapted to provide, in a first position, open fluid communication between the inflation passageway and the exterior wall of the housing through said first passageway whereby the packer is deflated, and, in a second position, open fluid communication between the inflation passageway and the inner bore through said second passageway whereby the packer can be inflated, a flapper valve adapted to substantially close the inner bore of the housing when the sleeve-shaped valve body is in its second position, actuating means capable of moving the sleeve-shaped valve body from said first to second positions and back, an acoustic receiver capable of receiving an acoustic signal and causing the actuating means to move the sleeve-shaped valve body.

17. The device of claim 16 wherein said at least one second passageway has at least one check valve interposed therein to substantially prevent deflation of the packer when the sleeve-shaped valve body is in the second position.

18. The device of claim 16 wherein the housing has a recess which is covered by the sleeve-shaped valve body when it is in its first position and houses the flapper valve.

19. The device of claim 18 wherein the flapper valve has lifting legs adapted to open the flapper valve and rotate it into said recess by contact with the sleeve-shaped valve body during its movement from said second position to said first position.

20. The device of claim 19 wherein the lifting legs have at least one cam ramp thereon adapted to contact the sleeve-shaped valve body.

21. The device of claim 16 wherein the sleeve-shaped valve body is adapted to provide said fluid communication in said first and second position by at least two circumferential recesses in the sleeve-shaped valve body adjacent the housing inner bore.

22. The device of claim 16 wherein the housing has circumferential recesses on its inner bore about the opening on the inner bore of the first passageway, about the two openings on the inner bore of the second passageway, and about the opening on the inner bore of the inflation passageway and the sleeve-shaped valve body has short longitudinal recesses adapted to cooperate with said circumferential recesses and provide said fluid communication in said first and second positions.

23. The device of claim 16 wherein the housing is adapted at its upper and lower ends to connect to well drilling pipe or collars.

24. The device of claim 16 wherein the actuating means comprise at least one electric motor.

25. The device of claim 24 wherein the actuating means comprise at least one assembly of two series of three electric motors driving a ballscrew through gears and a ballnut driven by the ballscrew and attached to the sleeve-shaped valve body.

26. The device of claim 25 wherein the ballscrew is adapted to comprise a brake when not slidably moving the sleeve-shaped valve body.

27. The device of claim 25 wherein limit switches are positioned about the ballnut so as to stop the sleeve-shaped valve body at either its first or second positions.

28. The device of claim 24 additionally comprising battery means suitable for powering said actuating means and said acoustic receiver.

29. The device of claim 24 additionally comprising a pressure switch adapted to electrically isolate said battery means when inner bore pressure nears atmospheric.

30. The device of claim 28 additionally comprising means adapted to allow charging of said battery means.

31. The device of claim 16 wherein the actuating means comprise at least one electric solenoid.

32. The device of claim 16 wherein the actuating means comprise hydraulic actuators.

33. The device of claim 16 wherein said acoustic receiver is adapted to be responsive to FSK signals of 310±20 Hz and 370±20 Hz.

34. The device of claim 33 wherein said acoustic receiver is adapted to be responsive to FSK signals of 316±4 Hz and 374±3 Hz.

35. A device suitable for use as a downhole blowout preventer in a well comprising:

a housing having an inner bore, an exterior wall, an inflatable packer which extends beyond the exterior wall when inflated, at least one first passageway extending between the inner bore and the exterior wall, at least one second passageway extending between an upper and a lower opening on the inner bore and having disposed therein at least one check valve disposed to allow a fluid to pass only from the upper to the lower opening, at least one inflation passageway extending between an opening on the inner bore and the packer, a flapper valve seating site located approximately circumferentially within the inner bore and adapted to accept a flapper valve and seal the inner bore, at last one flapper valve bypass passageway extending from an opening above to one below the flapper valve seating site, at least one check valve bypass passageway extending between an opening above the flapper valve seating site to the second passageway between its lower opening and the check valve, a safety sleeve removably and slidably mounted within the inner bore above the flapper valve seating site covering the openings to the flapper valve bypass passageway and the check valve bypass passageway whereby when the safety sleeve is slidably moved from the openings to the flapper bypass passageway and the check valve bypass passageway, the flapper bypass passageway provides open fluid communication from above to below the flapper valve seating site and open fluid communication between the packer and the inner bore so that the packer is deflatable, a control valve assembly having a sleeve-shaped valve body slidably mounted in the inner bore of the housing and adapted to provide, in a first position, open fluid communication between the inflation passageway and the exterior wall of the housing through said first passageway whereby the packer is deflated, and, in a second position, open fluid communication between the inflation passageway and inner bore through said second passageway whereby the packer can be inflated, a flapper valve adapted to substantially close the inner bore of the housing when the sleeve-shaped valve body is in its second position.

36. The device of claim 35 wherein the housing has a recess which is covered by the sleeve-shaped control valve body when it is in its first position and houses the flapper valve.

37. The device of claim 36 wherein the flapper valve has lifting legs adapted to open the flapper valve and rotate it into said recess from said flapper valve seating site by contact with the sleeve-shaped valve body during its movement from said second position to said first position.

38. The device of claim 37 wherein the lifting legs have at least one cam ramp thereon adapted to contact the sleeve-shaped valve body.

39. The device of claim 35 wherein the sleeve-shaped valve body is adapted to provide fluid communication in said first and second position by at least two circumferential recesses in the sleeve-shaped valve body adjacent the housing inner bore.

40. The device of claim 35 wherein the housing has circumferential recesses on its inner bore about the opening on the inner bore of the first passageway, about the two openings on the inner bore of the second passageway, and about the opening on the inner bore of the inflation passageway and the sleeve-shaped valve body has short longitudinal recesses adapted to cooperate with said circumferential recesses and provide said fluid communication in said first and second positions.

41. The device of claims 35, 36, 37, 38, 39, or 40 additionally comprising actuating means for slidably moving the sleeve-shaped valve body from said first to second position and back.

42. The device of claim 41 wherein the actuating means comprise at least one electric motor.

43. The device of claim 42 wherein the actuating means comprise at least one assembly of two series of three electric motors driving a ballscrew through gears and a ballnut driven by the ballscrew and attached to the sleeve-shaped valve body.

44. The device of claim 43 wherein the ballscrew is adapted to comprise a brake when not slidably moving the sleeve-shaped valve body.

45. The device of claim 44 wherein limit switches are positioned about the ballnut so as to stop the sleeve-shaped valve body at either its first or second positions.

46. The device of claim 41 wherein the actuating means comprise at least one electric solenoid.

47. The device of claim 41 wherein the actuating means comprise a hydraulic actuator.

48. The device of claim 35 wherein the housing is adapted at its upper and lower ends to connect to well drilling pipe or collars.

49. The device of claim 35 wherein the safety sleeve is adapted to matingly engage a go-devil and slide downwardly in the inner bore upon application of downward pressure.

50. The device of claim 49 wherein the safety sleeve is removably mounted in the inner bore with shear pins.

51. The device of claim 35, 49, or 50 wherein the safety sleeve is adapted to matingly engage a latch on a wire line and slide upwardly in the inner bore upon application of upward pressure on said wire line.

52. A device suitable for use as a downhole blowout preventer in a well comprising:

a housing having an inner bore, an exterior wall, an inflatable packer which extends beyond the exterior wall when inflated, at least one first passageway extending between the inner bore and the exterior wall, at least one second passageway extending between an upper and lower opening on the inner bore and having disposed therein at least one check valve disposed to allow a fluid to pass only from the upper to the lower opening, at least one inflation passageway extending between an opening on the inner bore and the packer, a flapper valve seating site located approximately circumferentially within the inner bore and adapted to accept a flapper valve and seal the inner bore, at least one flapper valve bypass passageway extending from an opening above to one below the flapper valve seating site, at least one check valve bypass passageway extending between an opening above the flapper valve seating site to the second passageway between its lower opening and the check valve whereby when the safety sleeve is slidably moved from the openings to the flapper bypass passageway and the check valve bypass passageway, the flapper bypass passageway provides open fluid communication from above to below the flapper valve seating site and open fluid communication between the packer and the inner bore so that the packer is deflatable, a safety sleeve removably and slidably mounted within the inner bore above the flapper valve seating site covering the openings to the flapper valve bypass passageway and the check valve bypass passageway, a control valve assembly having a sleeve-shaped valve body slidably mounted in the inner bore of the housing and adapted to provide, in a first position, open fluid communication between the inflation passageway and the exterior wall of the housing through said first passageway whereby the packer is deflated, and, in a second position, open fluid communication between the inflation passageway and the inner bore through said second passageway whereby the packer is inflatable, a flapper valve adapted to substantially close the inner bore of the housing when the sleeve-shaped valve body is in its second position, actuating means capable of moving the sleeve-shaped valve body from said first to second positions and back, an acoustic receiver capable of receiving an acoustic signal and causing the actuating means to move the sleeve-shaped valve body.

53. The device of claim 52 wherein the housing has a recess which is covered by the sleeve-shaped control valve body when it is in its first position and houses the flapper valve.

54. The device of claim 53 wherein the flapper valve has lifting legs adapted to open the flapper valve and rotate it into said recess from said flapper valve seating site by contact with the sleeve-shaped valve body during its movement from said second position to said first position.

55. The device of claim 54 wherein the lifting legs have at least one cam ramp thereon adapted to contact the sleeve-shaped valve body.

56. The device of claim 52 wherein the sleeve-shaped valve body is adapted to provide fluid communication in said first and second position by at least two circumferential recesses in the sleeve-shaped valve body adjacent the housing inner bore.

57. The device of claim 52 wherein the housing has circumferential recesses on its inner bore about the opening on the inner bore of the first passageway, about the two openings on the inner bore of the second passageway, and about the opening on the inner bore of the inflation passageway and the sleeve-shaped valve body has short longitudinal recesses adapted to cooperate with said circumferential recesses and provide said fluid communication in said first and second position.

58. The device of claim 52 wherein the housing is adapted at its upper and lower ends to connect to well drilling pipe or collars.

59. The device of claim 52 wherein the actuating means comprise at least one electric motor.

60. The device of claim 59 wherein the actuating means comprise at least one assembly of two series of three electric motors driving a ballscrew through gears and a ballnut driven by the ballscrew and attached to the sleeve-shaped valve body.

61. The device of claim 60 wherein the ballscrew is adapted to comprise a brake when not slidably moving the sleeve-shaped valve body.

62. The device of claim 60 wherein limit switches are positioned about the ball nut travel so as to stop the sleeve-shaped valve body at either its first or second positions.

63. The device of claim 59 additionally comprising battery means suitable for powering said actuating means and said acoustic receiver.

64. The device of claim 63 additionally comprising a pressure switch adapted to electrically isolate said battery means when inner bore pressure nears atmospheric.

65. The device of claim 63 additionally comprising means adapted to allow charging of said battery means.

66. The device of claim 52 wherein said acoustic receiver is adapted to be responsive to FSK signals of $310 \pm 20$ Hz and $370 \pm 20$ Hz.

67. The device of claim 66 wherein said acoustic receiver is adapted to be responsive to FSK signals of $316 \pm 4$ Hz and $374 \pm 3$ Hz.

68. The device of claim 52 wherein the actuating means comprise at least one electric solenoid.

69. The device of claim 52 wherein the actuating means comprise hydraulic actuators.

70. The device of claim 52 wherein the safety sleeve is adapted to matingly engage a go-devil and slide downwardly in the inner bore upon application of downward pressure.

71. The device of claim 70 wherein the safety sleeve is removably mounted in the inner bore with shear pins.

72. The device of claims 52, 70, or 71 wherein the safety sleeve is adapted to matingly engage a latch on a wire line and slide upwardly in the inner bore upon application of upward pressure on said wire line.

* * * * *